US009588527B2

(12) United States Patent
Gavrilov

(10) Patent No.: US 9,588,527 B2
(45) Date of Patent: Mar. 7, 2017

(54) METHOD OF OPERATING ON-LOAD TAP CHANGER

(71) Applicant: Maschinenfabrik Reinhausen GmbH, Regensburg (DE)

(72) Inventor: Andrey Gavrilov, Regensburg (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 0 days.

(21) Appl. No.: 14/761,372

(22) PCT Filed: Jan. 15, 2014

(86) PCT No.: PCT/EP2014/050697

§ 371 (c)(1),
(2) Date: Jul. 16, 2015

(87) PCT Pub. No.: WO2014/127932

PCT Pub. Date: Aug. 28, 2014

(65) Prior Publication Data

US 2015/0338861 A1 Nov. 26, 2015

(30) Foreign Application Priority Data

Feb. 20, 2013 (DE) ..... 10 2013 101 652

(51) Int. Cl.

| | |
|---|---|
| ***G05F 1/20*** | (2006.01) |
| ***H01F 29/04*** | (2006.01) |
| ***H01H 9/00*** | (2006.01) |

(52) U.S. Cl.
CPC ..... *G05F 1/20* (2013.01); *H01F 29/04* (2013.01); *H01H 9/0005* (2013.01)

(58) Field of Classification Search
CPC ..... H02P 13/06
See application file for complete search history.

(56) References Cited

U.S. PATENT DOCUMENTS 5,604,423 A * 2/1997 Degeneff ..... G05F 1/20 323/258
5,969,511 A 10/1999 Asselman
(Continued)

*Primary Examiner* — Emily P Pham
(74) *Attorney, Agent, or Firm* — Andrew Wilford

(57) ABSTRACT

The invention relates to an on-load tap changer (1) for controlling voltage, comprising semiconductor switching elements (61, 62, 71, 72), and to a method for controlling voltage for a variable transformer (2). The on-load tap changer (1) has a first load branch (6) and a second load branch (7) arranged parallel thereto. A partial winding (8) is arranged between the first and second load branches (6, 7). In the first load branch (6), a first semiconductor switching element (61) is provided upstream of the partial winding (8) and a second semiconductor switching element (62) is provided downstream of the partial winding (8). In the second load branch (7), a first semiconductor switching element (71) is provided upstream of the partial winding (8) and a second semiconductor switching element (72) is provided downstream of the partial winding (8). The on-load tap changer (1) consists of at least one switching module (5), which comprises the first load branch (6) and the second load branch (7) of the on-load tap changer.

10 Claims, 4 Drawing Sheets

(56) References Cited

U.S. PATENT DOCUMENTS

| | | | | |
|---|---|---|---|---|
| 6,867,570 | B2 * | 3/2005 | Vithayathil | H02J 3/1828 323/205 |
| 2011/0005910 | A1 * | 1/2011 | Fujita | H01H 9/0011 200/5 B |
| 2012/0249277 | A1 * | 10/2012 | Kraemer | H01F 29/04 336/145 |
| 2012/0306471 | A1 * | 12/2012 | Green | H01H 9/542 323/355 |
| 2013/0249528 | A1 | 9/2013 | Biskoping | |

* cited by examiner

METHOD OF OPERATING ON-LOAD TAP CHANGER

CROSS REFERENCE TO RELATED APPLICATIONS

This application is the US-national stage of PCT application PCT/EP2014/050697 filed 15 Jan. 2014 and claiming the priority of German patent application 102013101652.9 itself filed 20 Feb. 2013.

FIELD OF THE INVENTION

The invention relates to an on-load tap changer with semiconductor switches. In particular, the on-load tap changer consists of a plurality of switching modules and is connected with a control winding. In addition, the invention relates to a method of operating an on-load tap changer.

BACKGROUND OF THE INVENTION

A tap changer for voltage regulation with semiconductor switching units is known from DE 10 2011 012 080 A1. The tap changer has two parallel load branches, and semiconductor switching units are connected in series in both load branches. In that case, a respective semiconductor switch of the first load branch and of the second load branch are mutually opposite in pairs. A respective sub-winding and bridge are connected, in alternation between these paired semiconductor switches, and switch between the two load branches. The sub-windings have different winding counts. The semiconductor switches can be constructed as thyristor pairs or IGBT pairs. The windings can be switched on and off by adept switching of the semiconductor switches. The step up or step down of the transformer can thereby be adapted and the voltage at the secondary side thus regulated. It is also possible, through use of IGBTs, to realize with the help of pulse-width modulation an alternating switching on and switching off of a sub-winding and to thereby implement a finely stepped voltage regulator. Switching losses arise due to constant switching-on and switching-off of the semiconductor switches and the semiconductor switches heat up, which imposes a high stress on the cooling device.

OBJECT OF THE INVENTION

The object of the invention is to provide an on-load tap changer for voltage regulation with semiconductor switches that has lower switching losses, requires a smaller cooling device and is thus more economic and reliable.

Another object is to provide a method of operating such a tap changer with semiconductor switches in which there are lower switching losses, less heat output, and more reliability.

SUMMARY OF THE INVENTION

This object is fulfilled by an on-load tap changer according to the invention for voltage regulation using two IGBTs that are connected anti-serially, with inverse diodes as semiconductor switches and in the case of pulse-width modulation to take into account the direction of the current and orientation of the voltage at the sub-winding so as to then not switch off a part of the load branch and to thus avoid switching losses.

According to the preferred form of embodiment of the invention the on-load tap changer for voltage regulation comprises semiconductor switches and is at a control transformer with control windings. This is between a fixed unregulated part of the control winding and a load line. Moreover, the on-load tap changer has a first load branch and a second load branch arranged parallel thereto, and a sub-winding is provided between the load branches. The first load branch has a upstream semiconductor switch upstream of the sub-winding and a downstream semiconductor switch downstream of the sub-winding. The second load branch similarly has an upstream semiconductor switch upstream of the sub-winding and a downstream semiconductor switch downstream of the sub-winding. The on-load tap changer comprises at least one switching module that comprises the first load branch and the second load branch.

According to a further embodiment of the invention each semiconductor switch consists of a respective first IGBT and second IGBT that are connected anti-serially with respect to one another. The IGBTs are each provided with a respective inverse diode in such a way that an anode of one inverse diode is connected with an emitter terminal and a cathode of the inverse diode is connected with a connector terminal of the first IGBT and of the second IGBT. The semiconductor switches of the first load branch and the second load branch can in that case be selectably switched off.

According to another embodiment the on-load tap changer consists of a first switching module, a second switching module and a third switching module. In that case, the sub-windings of the switching modules respectively have different winding ratios from one another, for example 9:3:1.

In the method according to the invention for operation of the on-load tap changer it is initially determined between which settings a sub-winding of a switching module shall be changed. In the case of a reducing setting windings of the sub-winding are subtracted from a control winding, in the case of an increasing setting windings of the sub-winding are added to the control winding and in the case of a nominal setting the sub-winding is left out completely.

A further step according to the method in accordance with the invention relates to determination of an active side and a passive side of the switching module. The semiconductor switches are actuated on the active side of the switching module, whilst these are shifted into a fixed switching setting on the opposite side.

After determination of the direction of a current and the orientation of a voltage at the sub-winding the switching states of the semiconductor switches of the switching module are defined. In that case, the IGBTs that are connected to the alternatingly current-conducting inverse diodes of the respective active side, of the upstream semiconductor switches or downstream semiconductor switches are constantly blocking. Of the two alternately current-conducting IGBTs of the active side one is always conducting and, in particular, that IGBT whose collector terminal is connected with a negative pole and the emitter terminal is connected with a positive pole of the sub-winding. Of the two alternately current-conducting IGBTs of the active side one is cycled and, in particular, that at which the collector terminal is connected with the positive pole and the emitter terminal with the negative pole of the sub-winding. At the passive side, one semiconductor switch is constantly blocked and the other semiconductor switch is constantly conducting.

In the case of change of the direction of the current flow and orientation of the positive pole and the negative pole at the sub-winding it is ascertained which IGBTs of the semiconductor switches on the active side are switched to be cycled or conducting and on the passive side are switched to be conducting or non-conducting, and generally which of the sides is active or passive.

BRIEF DESCRIPTION OF THE DRAWING

These and other features and advantages of the embodiment disclosed here will be better understood by reference to the following description and the drawings, in which the same reference numerals throughout denote the same elements and in which.

SPECIFIC DESCRIPTION OF THE INVENTION

Figure 1:
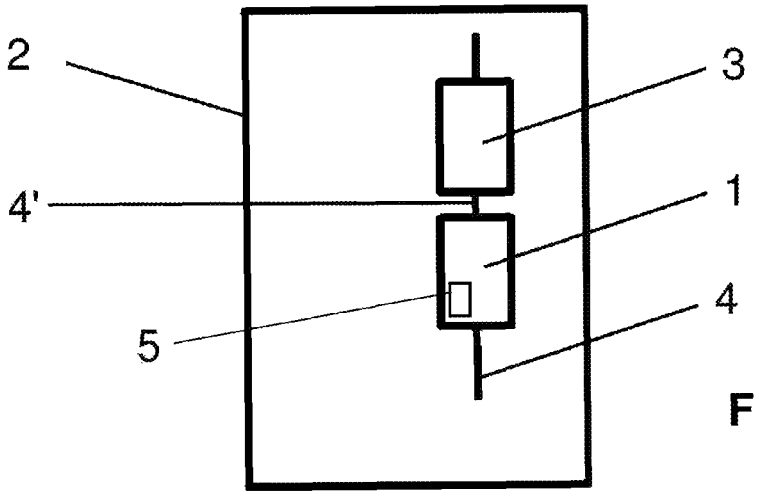
FIG. 1 is a schematic view of a tap changer in conjunction with a transformer.

Identical reference numerals are used for the same or equivalent elements of the invention. The illustrated embodiment represents merely one possibility of how the switch according to the invention can be realized.

An on-load tap changer 1 for voltage regulation in a control transformer 2 and a control winding 3 is shown schematically in FIG. 1. The on-load tap changer 1 is connected by an input line 4' to the fixed, unregulated part of the control winding 3 and to a load via an output line 4.

Figure 2:
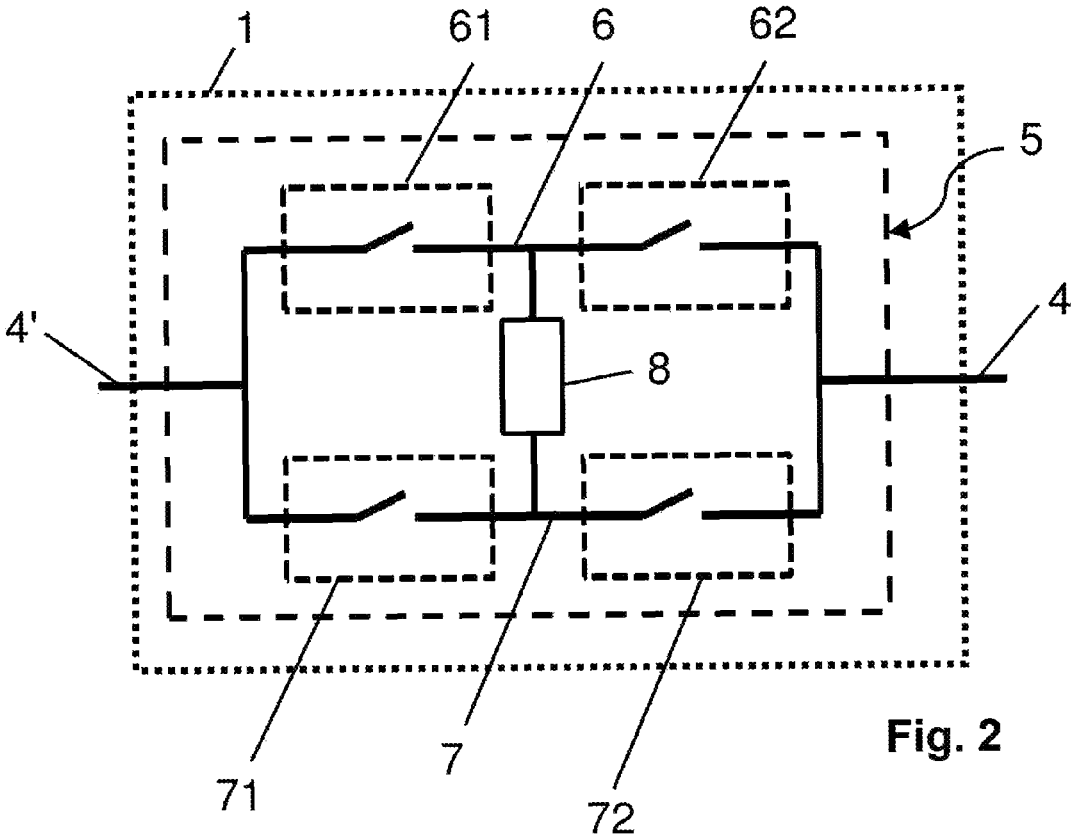
FIG. 2 is a schematic view of the tap changer with semiconductor switches.

As illustrated in FIG. 2, the on-load tap changer 1 consists of at least one switching module 5 that has a first load branch 6 and a second load branch 7 parallel thereto. The first and second load branches 6 and 7 of the switching module 5 are conductively connected together by a sub-winding 8. The first load branch 6 has an upstream semiconductor switch 61 between the control winding 3 and the sub-winding 8 and a downstream semiconductor switch 62 downstream of the sub-winding 8, thus toward the output line 4. The second load branch 7 similarly has an upstream semiconductor switch 71 upstream of the sub-winding 8 and a downstream semiconductor switch 72 downstream of the sub-winding 8.

Figure 3:
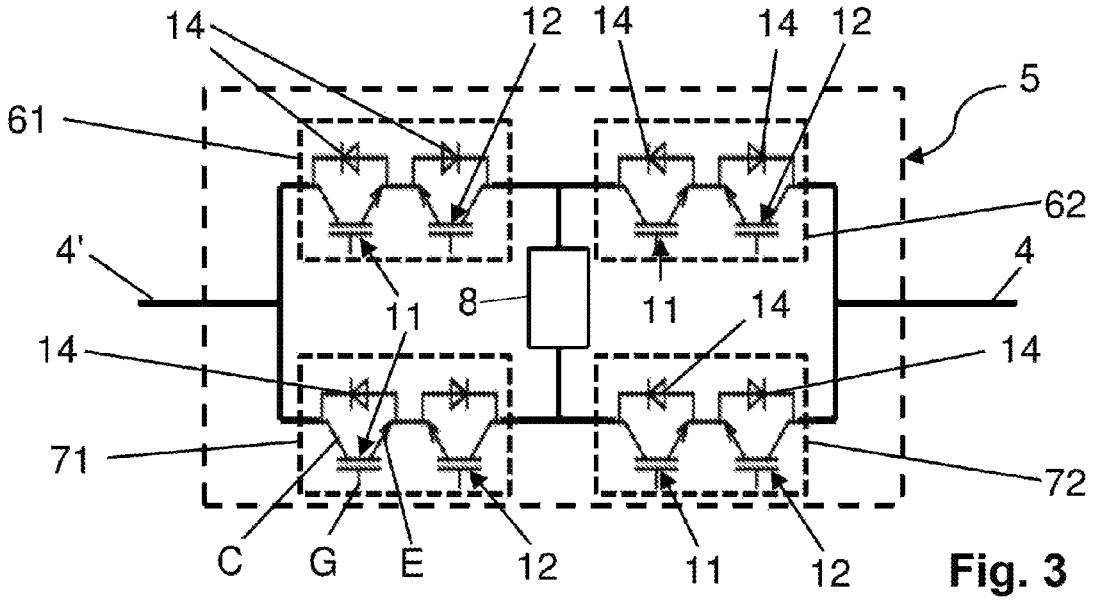
FIG. 3 is a view of the electronic construction of the semiconductor switches.
Figure 4A:
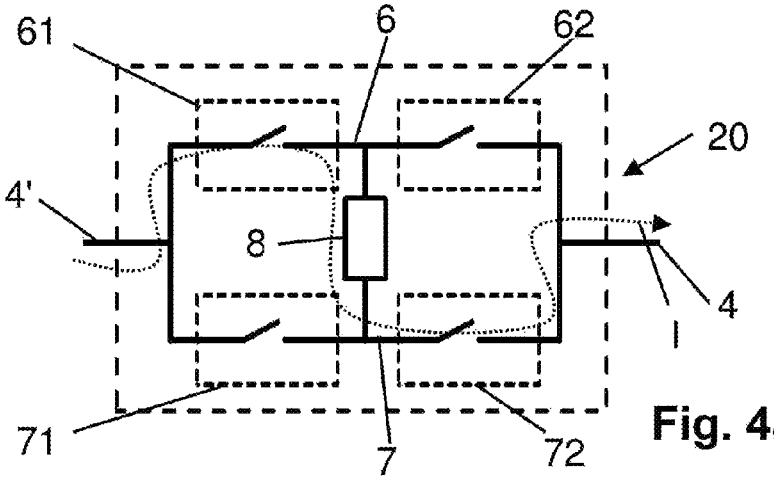
FIGS. 4*a*-4*d* are views of the different switching settings of the on-load tap changer.
Figure 4B:
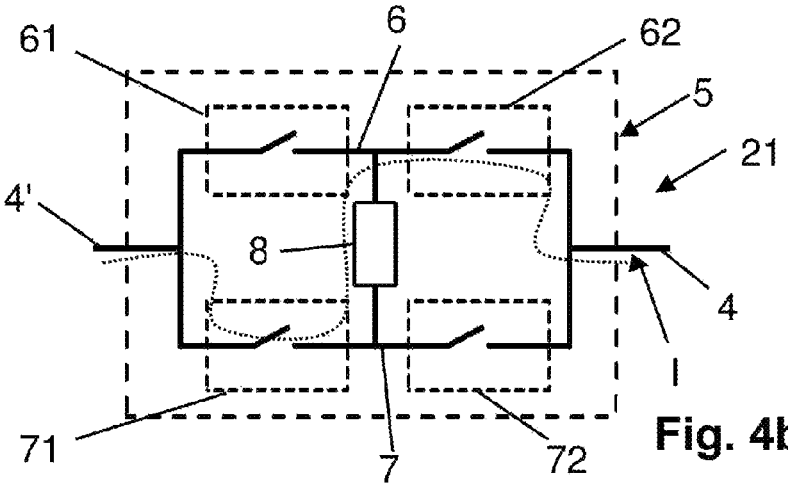
Figure 4C:
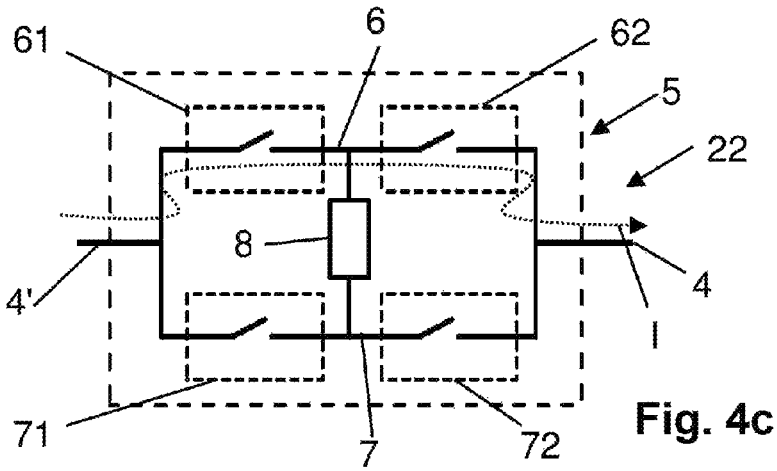
Figure 4D:
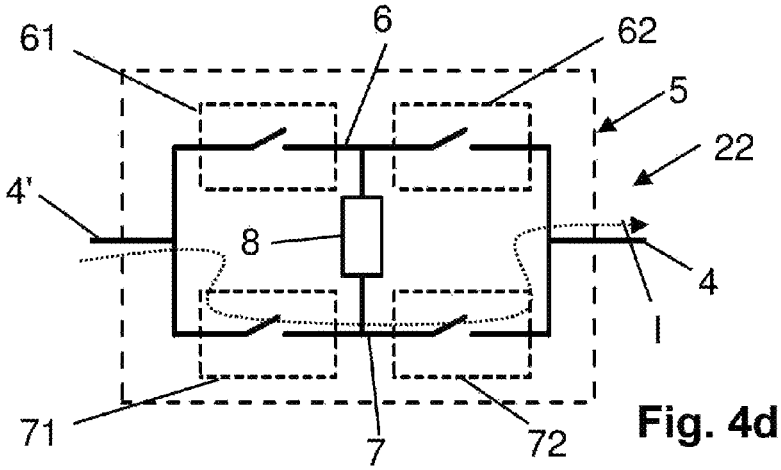

FIG. 3 shows how each of the semiconductor switches 61, 62, 71 and 72 consists of a first Insulated Gate Bipolar Transistor (IGBT) 11 and a second IGBT 12 that are connected anti-serially. The first IGBTs 11 and the second IGBTs 12 are each provided with a respective inverse diode 14. Each IGBT 11 and 12 has a collector terminal C, an emitter terminal E and a gate terminal G. Each of the inverse diodes 14 is connected by its anode with the emitter terminal E and by its cathode with the collector terminal C of the respective IGBT 11 or 12.

As illustrated in FIGS. 4*a*-4*d*, it is initially determined which of the settings the sub-winding 8 adopts. In a reducing setting 20 (FIG. 4*a*) the windings of the sub-winding 8 are subtracted from the fixed part of the control winding 3. In that case, the current I flows in direction-independent manner through the upstream semiconductor switch 61 in the first load branch 6, the sub-winding 8 and the downstream semiconductor switch 72 in the second load branch 7.

In an increasing setting 21 (FIG. 4*b*) the windings of the sub-winding 8 are added to the fixed part of the control winding 3. In that case, the current I flows in direction-independent manner through the upstream semiconductor switch 71 in the second load branch 7, the sub-winding 8 and the downstream semiconductor switch 52 in the first load branch 6.

In a nominal setting 22 (FIGS. 4*c* and 4*d*) the current I is selectively conducted past the sub-winding 8 by either the first load branch 6 or the second load branch 7. In this setting the windings of the sub-winding 8 have no influence on the control winding 3.

In order to be able to implement a finely stepped regulation and produce an intermediate step there is cycling between two of the three explained settings by pulse-width modulation. If there is switching between the nominal setting 22 and the reducing setting 20 or increasing setting 21, a passive side and an active side of the switching module 5 has to be ascertained; this is the regulation case. Always belonging to a respective side are the semiconductor switches 61 and 71 or 62 and 72, respectively that lie on the same side, thus upstream of or downstream of the sub-winding 8. It thus has to be ascertained whether the upstream semiconductor switch 61 of the first load branch 6 and the upstream semiconductor switch 71 of the second load branch 7 are active and the downstream semiconductor switch 62 of the first load branch 6 and the downstream semiconductor switch 72 of the second load branch 7 are passive, or conversely. Depending on this determination, the IGBTs 11 and 12 of the semiconductor switches 61, 62, 71 and 72 have to be differently switched. The semiconductor switches on the ascertained passive side are always kept conducting or blocking during the procedure such that one semiconductor switch is conducting and the other is non-conducting. On the active side, the semiconductor switches are, due to the pulse-width modulation carried out, switched to be active, i.e. these adopt different states. In the case of switching between the reducing setting 20 and the increasing setting 21, both sides are active.

Figure 5:
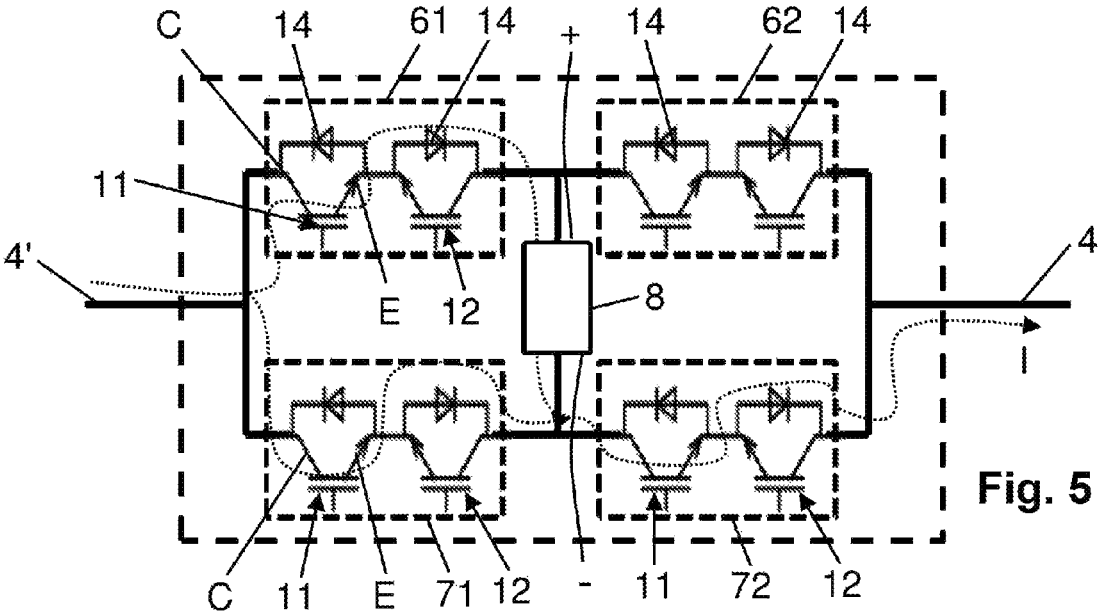
FIG. 5 is a view of the semiconductor switches in a switching setting.

In the example of FIG. 5 the active side of the illustrated switching module 5 consists of the upstream semiconductor switch 61 of the first load branch 6 and the upstream semiconductor switch 71 of the second load branch 7. Consequently, the passive side of FIG. 5 consists of the downstream semiconductor switch 62 of the first load branch 6 and the downstream semiconductor switch 72 of the second load branch 7.

On the passive side, the downstream semiconductor switch 72 of the second load branch 7 is always conducting. The downstream semiconductor switch 62 of the load branch 6 is, on the other hand, always non-conducting. The current I thus flows either through the first IGBT 11 and the inverse diode 14 that is connected with the second IGBT 12, or oppositely through the second IGBT 12 and the inverse diode 14 that is connected with the first IGBT 11. The first and second IGBTs 11 and 12 of the downstream semiconductor switch 62 in the first load branch 6 are, thereagainst, always blocking so that no current I flows here.

On the active side, the first or second IGBTs 11 or 12 of the upstream semiconductor switches 61 and 71, whose pass direction does not correspond with the current flow direction, are blocked. In that case, the current I flows via the inverse diodes 14 connected in parallel therewith. Of the remaining two IGBTs 11 or 12 of the upstream semiconductor switches 61 and 71 one is always conducting and, in particular, that IGBT whose collector terminal C is connected with a negative pole '−' and the emitter terminal E with a positive pole '+' of the sub-winding 8, possibly by other IGBTs or inverse diodes. Finally, the fourth IGBT of the active side is cycled at a duty cycle corresponding with the intermediate step to be achieved. The collector terminal C of this IGBT thus lies at the positive pole '+' and the emitter terminal E at the negative pole '−'.

The anti-serial IGBT opposite the cycled IGBT of the respective semiconductor switch is switched on shortly ahead of the current zero transition so as to ensure a secure current path during the current direction change.

In the example in FIG. 5, the orientation of the voltage U is such that the positive pole '+' lies at the upper side of the sub-winding 8 and the negative pole '−' lies at the lower side. Since the current I flows from left to right, use is made for that purpose of the first IGBTs 11 of the upstream semiconductor switches 61 and 71 and the inverse diodes 14 that are connected in parallel with the second IGBT 12 of the upstream semiconductor switches 61 and 71. With consideration of the first IGBTs 11 of the upstream semiconductor switches 61 and 71, then the positive pole '+' of the sub-winding 8 lies at the collector terminal C of the first IGBT 11 of the upstream semiconductor switch 71 in the second load branch 7 and the negative pole '−' of the sub-winding 8 lies at the emitter terminal E. This is thus cycled, whereas the first IGBT 11 of the upstream semiconductor switch 61 and the first load branch 6 is permanently conducting. The second IGBT 12 of the upstream semiconductor switch 71 in the second load branch 7 is switched to be conducting shortly ahead of the current zero transition, thus in advance of the direction change of the current I.

After each voltage or current direction change it is always newly defined which IBGTs are conductive that are blocking and which are cycled. In that case, a change of the active side and passive side can serve for uniform distribution of the losses and thus lead to lengthening of the service life of the components.

In the case of pure ohmic loads of the on-load tap changer 1 the direction of the current I and the orientation of the voltage U at the sub-winding 8 change at the same time. In the case of inductive and capacitive loads, the orientation of the voltage U changes with an offset relative to the directional change of the current I.

Figure 6:
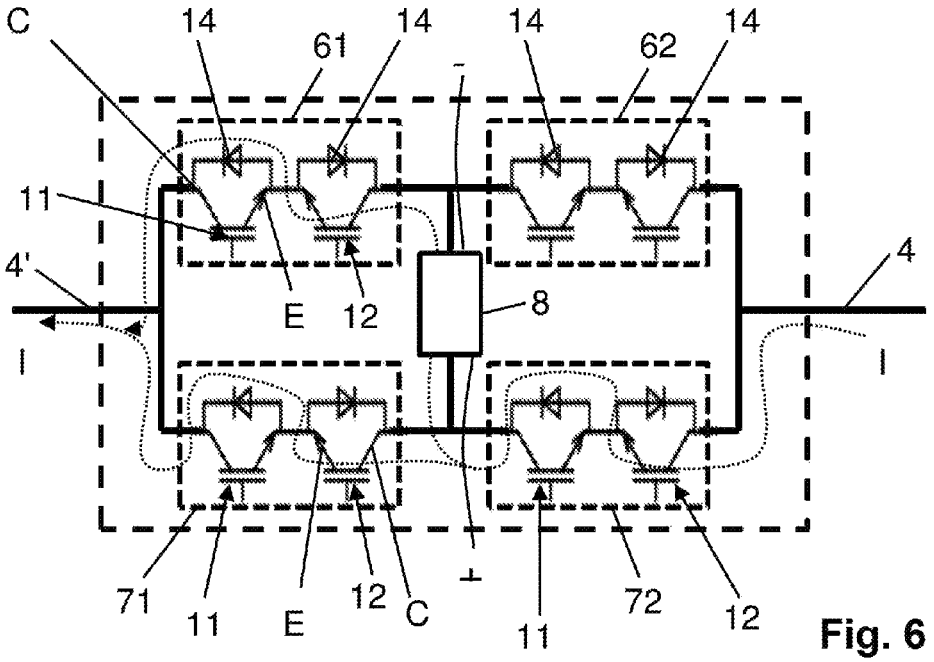
FIG. 6 is a further view of a switching setting of the semiconductor switch.

The switching module 5 of FIG. 5 is illustrated in FIG. 6. The lefthand side of the switching module 5 with the semiconductor switches 61 and 71 is, as previously determined, still always active and the right-hand side of the switching module 5 with the semiconductor switches 62 and 72 is passive. Here, the direction of the current I has changed, so that this flows from the right-hand side to the lefthand side of the switching module 5. Starting from an ohmic load, the orientation of the voltage U at the sub-winding 8 has similarly also reversed. The negative pole '−' now lies at the upper end of the sub-winding 8 and the positive pole '+' now lies at the lower end of the sub-winding 8.

On the passive side, the current I is conducted by the downstream semiconductor switch 72 in the second load branch 7, particularly the second IGBT 12 of the downstream semiconductor switch 72 and the inverse diode 14 that is connected in parallel with the first IGBT 11 of the downstream semiconductor switch 72. The downstream semiconductor switch 62 in the first load branch is in that case always non-conducting. On the active side of the switching module 5 the current I can flow only by the inverse diodes 14 that are connected in parallel with the first IGBTs 11 of the downstream and downstream semiconductor switches 61 and 71, as well as the second IGBTs 12 of the downstream and downstream semiconductor switches 61 and 71. In that case, the positive pole '+' lies at the collector terminal C of the second IGBT 12 of the upstream semiconductor switch 71 in the second load branch 7; this is thus cycled. Since the second IGBT 12 of the upstream semiconductor switch 71 in the second load branch 7 is cycled, the second IGBT 12 of the upstream semiconductor switch 61 in the load branch 6 is consequently switched to be permanently conducting.

Due to the fact that during the method one semiconductor switch 61, 61, 71 or 72 on the active side is always permanently conducting, i.e. at low-impedance, switching losses arising in the prior art on transition from the high-impedance state to the low-impedance state are significantly reduced. Heat output at the switching module 5 thereby diminishes, so that less thermal energy has to be dissipated by the cooling. In general, in the case of use of this method a physically smaller and thus less expensive cooling plant can be employed.

Figure 7:
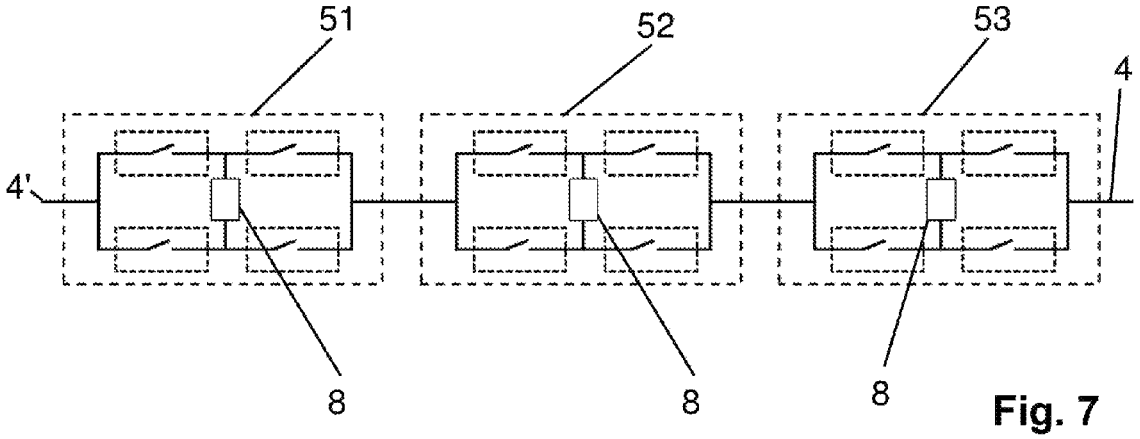
FIG. 7 is a schematic view of the connection of three switching modules.

An on-load tap changer 1 is depicted in FIG. 7, in which a first switching module 51, a second switching module 52 and a third switching module 53 are connected in series. The sub-windings 8 of these switching modules 51, 52 and 53 have different winding ratios. Distribution of the winding ratios in 9:3:1 is particularly advantageous. Through use of the method according to the invention in one of these switching modules 51, 52 or 53 it is possible to combine the finer intermediate steps, which are produced here, with the steps of the other switching modules 51, 52 and 53.

The invention claimed is:

1. A method of operating an on-load tap changer connected on an upstream side by an input line with a control transformer and a downstream side to an output line, the tap changer comprising the steps of:

providing a switching module having a first load branch having an upstream semiconductor switch connected to the input line and a downstream semiconductor switch connected between the upstream semiconductor switch and the output line, a second load branch parallel to the first load branch and having an upstream semiconductor switch connected to the input line and a downstream semiconductor switch connected between the upstream semiconductor switch of the second load branch and the output line, and a sub-winding of the control transformer connected between the first branch between the respective upstream and downstream switches thereof and the second branch between the respective upstream and downstream switches thereof;

whereby in a first position the upstream switch of the first branch is closed and the downstream switch of the first branch is open while the upstream switch of the second branch is open and the downstream switch of the second branch is closed for current flow from the input line to the output line in a first direction through the sub-winding;

in a second position the upstream switch of the first branch is open and the downstream switch of the first branch is closed while the upstream switch of the second branch is closed and the downstream switch of the second branch is open for current flow from the input line to the output line in a second direction opposite the first direction through the sub-winding;

in a third position both switches of one of the load branches are closed and there is no current flow through the sub-winding;

for setting an intermediate position, switching back and forth between the third position and the first position by switching one of the switches that is open in the first position back and forth between open and closed; or switching back and forth between the third position and the second position by switching one of the switches that is open in the second position back and forth between open and closed.

2. The method defined in claim 1, wherein each semiconductor switch consists of a respective first IGBT and second IGBT that are connected anti-serially with respect to one another, the first IGBT and the second IGBT are each provided with an inverse diode in such a way that an anode of one inverse diode is connected with an emitter terminal and a cathode of an inverse diode is connected with a collector terminal of the first IGBT and the second IGBT and the semiconductor switches of the first load branch and the second load branch are selectably switchable off.

3. The method defined in claim 1, wherein the on-load tap changer consists of a first switching module, a second switching module and a third switching module and the sub-windings of the switching modules have different winding ratios with respect to one another.

4. The method defined in claim 3, wherein a winding ratio of the sub-windings is 9:3:1.

5. The method according to claim 1, further comprising the steps of:

in the case of a reducing setting, windings of the sub-winding are subtracted from a control winding, in the case of an increasing setting, windings of the sub-winding are added to the control winding, and in the case of a nominal setting, the sub-winding is left out completely.

6. The method according to claim 1, wherein the semiconductor switches are actuated on an active side of the switching module and the semiconductor switches remain in a fixed switching state on a passive side of the switching module.

7. The method defined in claim 1, wherein each semiconductor switch consists of a respective first IGBT and second IGBT that are connected anti-serially with respect to one another, the first IGBT and the second IGBT are each provided with an inverse diode in such a way that an anode of one inverse diode is connected with an emitter terminal and a cathode of an inverse diode is connected with a collector terminal of the first IGBT and the second IGBT, the IGBTs connected with the alternately current-conducting inverse diodes of the respective active side, of the upstream semiconductor switches or downstream semiconductor switches are constantly blocking, of the two alternately current-conducting IGBTs of the active side, one is always conducting and that IGBT whose collector terminal is connected with a negative pole and the emitter terminal is connected with a positive pole of the sub-winding, of the two alternately current-conducting IGBTs of the active side, one is cycled and that IGBT whose collector terminal is connected with the positive pole and whose emitter terminal with the negative pole of the sub-winding, and at a passive side, one semiconductor switch is always blocked and the other semiconductor switch is always conducting.

8. The method defined in claim 7, further comprising the step, in case of change in the direction of the current flow and the orientation of the positive pole and the negative pole, of:

detecting at the sub-winding which IGBTs of the semiconductor switch on the active side are cycled or switched to be conducting.

9. The method defined in claim 8, further comprising the step, in case of change in the direction of the current flow and the orientation of the positive pole and the negative pole, of:

detecting at the sub-winding which IGBTs of the semiconductor switch on the passive side are switched to be conducting or non-conducting.

10. The method defined in claim 9, further comprising the step, in case of change in direction of the current flow and the orientation of the positive pole and the negative pole, of:

determining the active side and the passive side at the sub-winding.

* * * * *